United States Patent [19]

Arena

[11] Patent Number: 4,887,414

[45] Date of Patent: Dec. 19, 1989

[54] ARTICLE SEPARATING AND LOADING APPARATUS

[75] Inventor: John P. Arena, Downsville, La.

[73] Assignee: Manville Corporation, Denver, Colo.

[21] Appl. No.: 240,975

[22] Filed: Sep. 6, 1988

[51] Int. Cl.[4] ..... B65B 21/06; B65B 35/44

[52] U.S. Cl. ..... 53/543; 53/48; 198/418.7

[58] Field of Search ..... 53/48, 448, 543; 198/420, 425, 456, 457, 575, 633, 418.7

[56] References Cited

U.S. PATENT DOCUMENTS

| | | | |
|---|---|---|---|
| 2,756,553 | 7/1956 | Ferguson et al. | 198/420 X |
| 3,028,946 | 4/1962 | Krupp et al. | 198/456 X |
| 3,174,259 | 3/1965 | Jones et al. | 53/48 |
| 3,225,510 | 12/1965 | Jones et al. | 53/48 |
| 3,778,959 | 12/1973 | Langen et al. | 53/48 X |
| 4,237,673 | 12/1980 | Calvert et al. | 53/48 |
| 4,566,248 | 1/1986 | Cooley | 53/48 |
| 4,693,055 | 9/1987 | Olsen, Jr. et al. | 198/425 X |

*Primary Examiner*—Robert L. Spruill
*Assistant Examiner*—Linda B. Johnson
*Attorney, Agent, or Firm*—John D. Lister

[57] ABSTRACT

A packaging machine for packaging containers such as bottles in a carton. Adjacent rows of bottles are conveyed downstream parallel to the downstream movement of spaced open-ended carton blanks. A separate conveying means in conjunction with stationary guides moves bottles diagonally downstream to the carton blanks. Wedge-shaped bottle separators are carried by the separate conveying means adjacent the carton blank moving means and engage adjacent bottles to separate the bottles into groups, which are then guided onto the blanks through the open ends thereof. The separators travel at the same speed as the carton blanks.

3 Claims, 5 Drawing Sheets

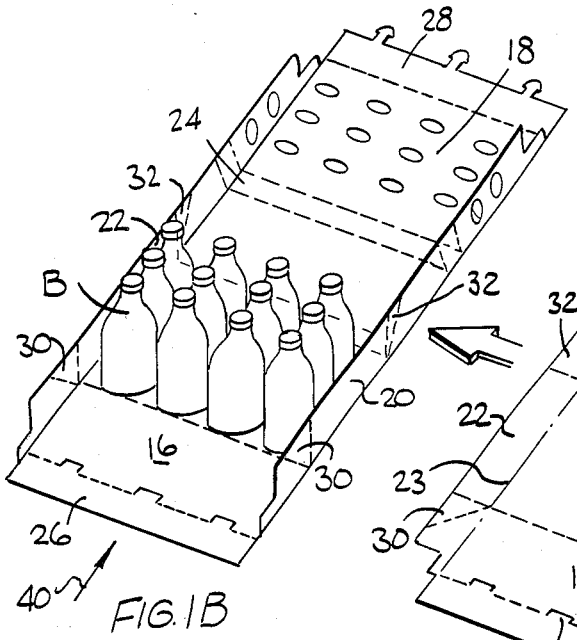
FIG. 1B
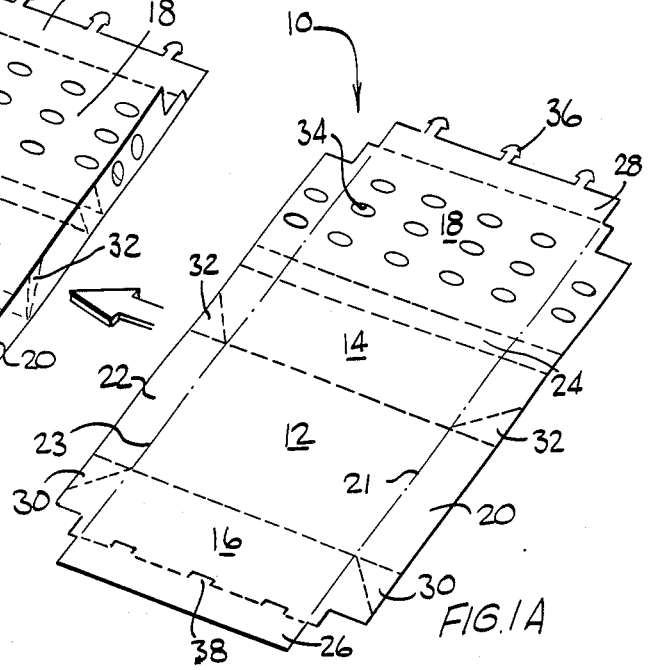
FIG. 1A
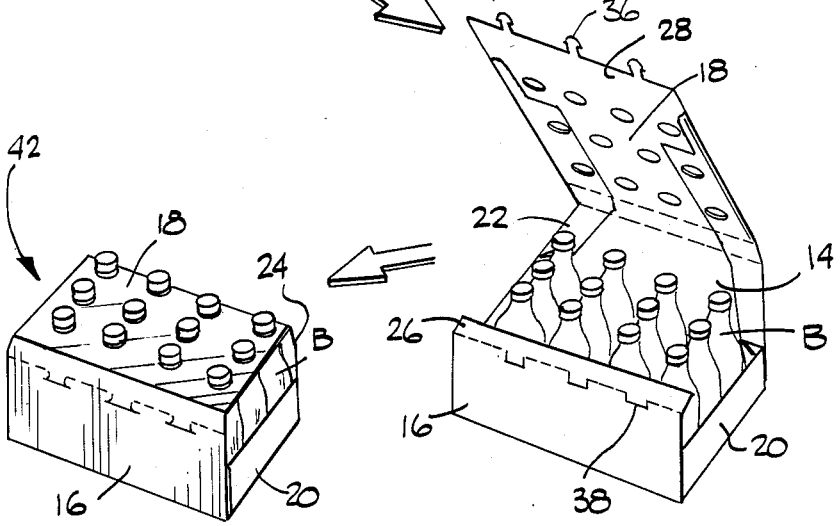
FIG. 1C
FIG. 1D 66
68
68
70
20
22
70
C
70
72
72
72
78
80
80
80
80
71
73
70
64
58
62
C
60
B
46
44

ARTICLE SEPARATING AND LOADING APPARATUS

FIELD OF THE INVENTION

This invention relates to article packaging machines. More particularly, it relates to a packaging machine for separating articles such as beverage containers and loading them into a carton blank in an intermediate stage of fabrication.

BACKGROUND OF THE INVENTION

A continuing problem in the packaging of beverage containers such as cans and bottles is to separate the containers into groups while the containers are moving through a packaging machine at very high speeds, and to load the groups into cartons which are also moving at very high speeds through the machine. The high speeds at which packaging machines are run require the containers to be moved and segregated in such a way as to minimize the danger of the containers falling and jamming the machine. The movement of the groups of containers into the rapidly moving cartons must also be carried out smoothly to avoid misalignment, which could also result in a jam.

The cartons in which beverage containers are packaged are commonly fed into the packaging machine in the form of generally flat folded blanks which are opened to create a carton in an intermediate stage of fabrication having open ends and leading and trailing upright panels. Various means for feeding and segregating the beverage containers into groups of the desired number have been employed. For example, endless chains carrying lugs for contacting and pushing the containers into partially folded blanks have been employed. Such arrangements require exact timing between the lug chains and both the principal container moving means and the carton moving means, and are not desirable for use in modern high speed packaging machines.

In another arrangement described in U.S. Pat. No. 3,778,959 to Langen et al, open-ended carton sleeves are moved downstream while rows of containers are fed to an adjacent conveyor. Container separating means in the form of rakes or arms are carried by the adjacent conveyor and extend across the width of the conveyor so as to separate the containers into groups. The groups are maintained in their segregated condition by the arms as the adjacent conveyor moves the groups of containers parallel to the carton sleeve moving means. Guide rails at a downstream location assist in moving the groups into the carton sleeves. Although an improvement over other slower more complicated machines, this machine requires a number of container conveyors working in concert to move the containers from the infeed conveyor to the carton sleeves. It also requires the separating arms to extend across the entire width of the adjacent conveyor in order to segregate the containers at an upstream point relatively distant from the location where the containers enter the carton sleeve. This in turn requires the separating arms to be structurally able to extend in cantilever fashion across the full width of the conveyor to which it is attached, resulting in a considerably more massive structural arrangement than desired, both with respect to the arms themselves, the conveyor carrying them, and the support structure connecting the arms and the conveyor. This in turn takes up more space within the confines of the packaging machine than desired.

Another approach to the problem is described in U.S. Pat. No. 4,237,673 to Calvert et al., which discloses a packaging machine in which carton blank sleeves are pushed over a support surface by flight bars. The flight bars extend beyond the ends of the carton sleeves across the remaining width of the support surface, and function as metering bars to separate the beverage containers into groups of predetermined number and to push the containers along the guides leading to the open ends of the carton sleeves. The containers must thus cross a dead plate in order to enter the carton, encountering friction forces which oppose a smooth passage into the carton. The metering bars, like the arms of Langen et al., are long and heavy, requiring strong support means and a relatively large amount of space in which the metering bars and their support structure can move. Further, by relying on line pressure and the movement of the metering bars to move the containers from the infeed conveyor to the carton sleeves, it is necessary to provide dampers to take up the container feed pressure. In addition, the use of combination flight bars and metering bars makes it a relatively time consuming process to change to a different carton size.

It would be desirable to employ a container feed which is not dependent upon the container line pressure to move containers downstream and which does not require an elongated bulky metering bar or arm to separate the containers into groups of predetermined number.

SUMMARY OF THE INVENTION

This invention employs carton blank moving means and means spaced therefrom for moving a row of articles to be packaged in a downstream direction. Means for propelling the articles from the article moving means to the blank moving means are provided, with the propelling means carrying means adjacent the carton blank moving means for separating the articles into groups of predetermined number.

In a preferred arrangement the carton blanks are pushed in a downstream direction and the article separating means comprises a wedge-shaped portion adjacent the carton blank pushing means. The wedge-shaped portion preferably extends upwardly from the article propelling means and in a direction away from the blank moving means, the latter distance being relatively short so as to engage only a single article at a time. In a preferred embodiment, the article separating wedge shaped elements are mounted on a moving tabletop chain. By this arrangement the article separating means does not have to extend across the path of travel of containers being moved from the infeed conveyor to the carton blank moving means as in the prior art machines, and the containers do not have to slide over a dead plate. Further, even though the separating means occupies a small space, thereby making the machine more compact and providing more room for the drive means of the various moving parts, it is nonetheless capable of separating articles in a plurality of rows of moving articles.

Other features and aspects of the invention, as well as other benefits of the invention, will readily be ascertained from the more detailed description of the invention which follows.

BRIEF DESCRIPTION OF THE DRAWING

FIGS. 1A–1D are pictorial views of a carton blank which can be used in carrying out the present invention, shown in progressive stages of formation in the process of forming a wrap-around carton;

DESCRIPTION OF THE PREFERRED EMBODIMENT

Figure 2A:
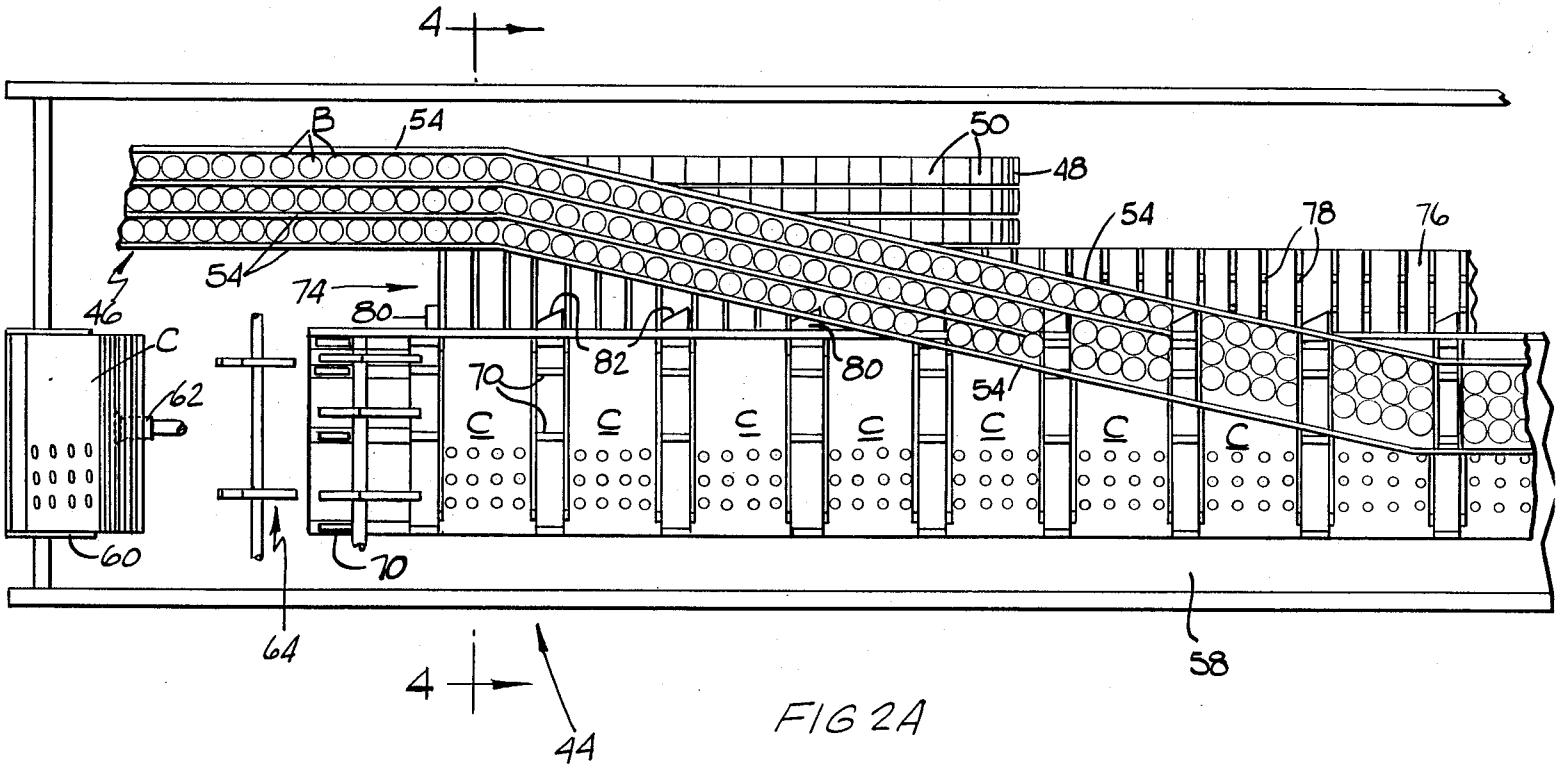
FIG. 2A is a plan view of the upstream portion of a packaging machine incorporating the article separating and loading apparatus of the invention.

Referring to FIG. 1A, a carton blank 10 adapted for use in the present invention comprises a bottom panel 12, side panels 14 and 16, a top panel 18, and end panels 20 and 22. The end panel 20, which is the trailing end panel of the carton blank as it moves through the packaging machine, is connected to the bottom, side and top panels by a score line 21. Similarly, the end panel 22 is the leading end panel of the carton blank as it moves through the machine, and is connected to the bottom, side and top panels by score line 23. A short sloped side panel 24 connects the side panel 14 and the top panel 18, while flaps 26 and 28, connected to the side panel 16 and the top panel 18, respectively, are adapted to overlap and form an opposite short sloped panel of the carton. The end panels 20 and 22 contain fold lines forming tuck panels 30 and 32, while the top panel 18 and adjacent portions of the end panels 20 and 22 contain openings 34 for receiving the necks of beverage bottles packaged in the carton. The flap 28 contains locking tabs 36, while the side panel 16 contains cooperating locking openings adjacent the flap 26.

In addition to the fold lines 21 and 23, the various panels referred to are connected to each other along fold lines which are shown in the drawing as dotted lines but are not, for the sake of clarity, identified by reference numerals.

To form a carton from the blank 10, the end panels 20 and 22 are folded up along the score lines 21 and 23 to the position shown in FIG. 1B, and beverage containers to be packaged, such as bottles B, are introduced to the bottom panel of the blanks by being pushed or slid, as indicated by the directional arrow 40, through the open end of the blank over the side panel 16.

Continuing on to FIG. 1C, the tuck panels 30 and 32 are then folded inwardly, causing the side panels 16 and 14 to be raised toward the vertical. Folding of the top panel 18 down over the necks of the bottles B and attaching the flaps 26 and 28 by means of tabs 36 and openings 38 results in the carton 42 illustrated in FIG. 1D.

Although the carton shown is illustrative of the type of carton which can be used in conjunction with the present invention, it should be understood that the invention is not limited to the loading of carton blanks of the form shown in FIG. 1B but may also be used with the more common open-ended carton sleeves. Also, although illustrated in connection with the packaging of beverage bottles, the invention can be used in connection with beverage cans or any other type of article which can be fed and introduced to a carton blank or sleeve in the same manner as a beverage can or bottle.

Figure 3:
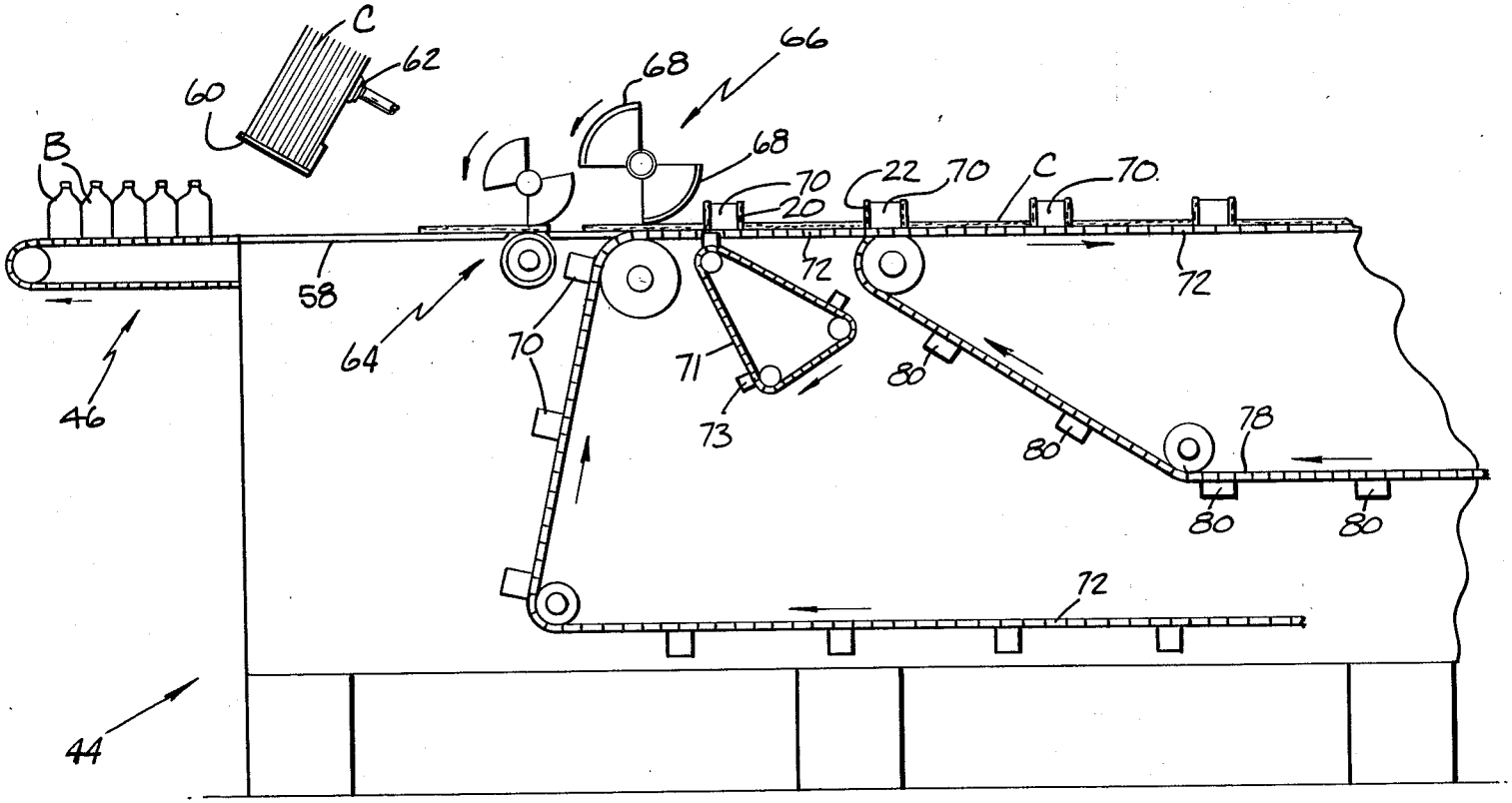
FIG. 3 is a side elevation, with portions of the machine structure removed for the purpose of clarity, of the upstream portion of the machine of the present invention.
Figure 4:
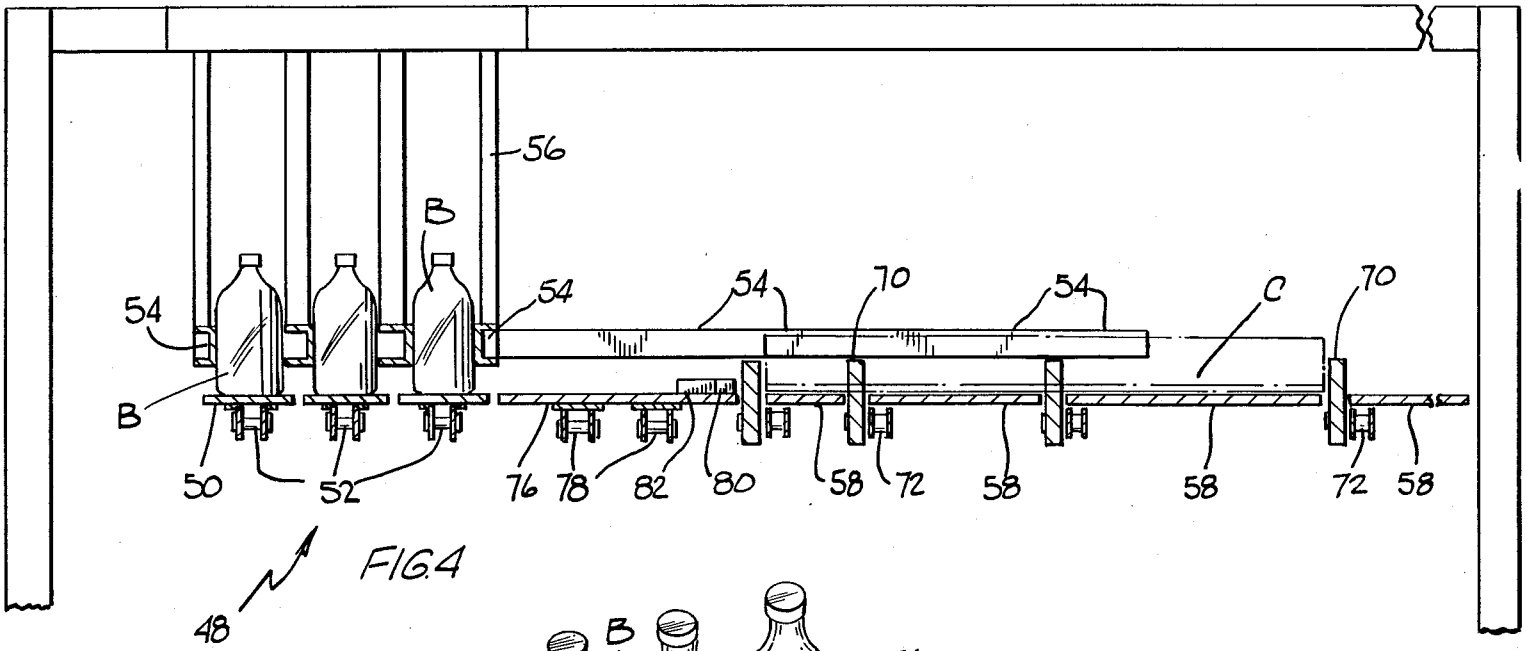
FIG. 4 is a transverse sectional view taken along line 4—4 of FIG. 2A.

Referring now to FIGS. 2A, 3 and 4, a packaging machine 44 comprises an infeed conveyor 46, preferably consisting of three adjacent spaced conveyors 48, for feeding articles such as bottles B into the packaging machine. The conveyors 48 may be of any suitable design, such as comprising a series of slats 50 attached to endless chains 52 for movement therewith. Guide rails 54, which may be connected to suitable support members 56 as shown in FIG. 4, separate the individual conveyors 48 to guide the movement of the incoming bottles along a substantial portion of the run of the conveyors 48.

Referring to FIGS. 2A and 3, spaced from the infeed conveyor is a support surface 58 which preferably takes the form of spaced slats or strips. A hopper 60 holds a stack of carton blanks C which are removed from the hopper one at a time by suction cup 62 mounted for reciprocation toward and away from the hopper by means well known in the art. A carton blank pulled from the hopper is moved by the suction cup to a position where the leading edge of the blank is engaged and pulled by segment rolls 64 and accelerated in a downstream direction, also as is well known in the art. A breaker wheel 66 mounted above the support surface 58 and consisting of spaced wheel segments 68 rotates such that its circumferential speed is slightly greater than the speed of chain 72. The chain 72 carries lugs 70 at spaced intervals thereon and is mounted so that its upper run is just beneath the surface 58 and so that the lugs 70 extend up above the surface 58 through suitable slots or spaces in the support surface. Just downstream from the breaker wheel beneath the support surface 58 is a set-up chain 71 which carries lugs 73 at spaced intervals thereon so that the lugs 73 are able to contact the bottom surface of a carton blank traveling above the set-up chain.

As a carton blank moves downstream from the segment rolls 64, the breaker wheel strikes the blank behind the score line of the leading end panel, that is, it strikes the blank behind the score line 23 of the blank shown in FIG. 1A, and a lug 73 on the set-up chain 71 kicks up the leading end panel 22 to set it against the trailing face of the adjacent lug 70. While the blank is still in the grip of the breaker wheel the trailing end panel 20 is folded up about its score line 21 by the next lug 70. By these actions the blank of FIG. 1A is folded into the shape shown in FIG. 1B. In this configuration it fits snugly in the space between adjacent lugs 70, as shown in FIGS. 2A and 3.

Referring to FIGS. 2A, 3 and 4, another conveyor 74 is located between the infeed conveyor 46 and the carton support surface 58. The conveyor 74 may take any convenient form, but is illustrated as comprising a series of spaced slats 76 connected to endless chains 78. Attached to the conveyor 74 at regularly spaced locations along the edge of the conveyor adjacent the path of movement of the carton blanks C are article separator pins or lugs 80. The lugs 80 may be attached directly to the slats 76 or the slats may be cut away at that area and the lugs 80 attached to structure carried by the nearest chain 78. In either case the lugs 80 are spaced apart on the conveyor 74 a distance equal to the spacing of the lugs 70. In other words, the distance between the lugs 80 is equal to the width of the carton blank shown in FIG. 1B. By moving the chains 72 and 78 so that their linear speeds are the same, and by aligning the lugs 80 with the lugs 70, the lugs 70 and 80 are caused to travel downstream adjacent each other and at the same speed.

As shown in FIGS. 2A and 4, the guide rails 54 extend diagonally from an upstream location on the infeed conveyor 46 to a location downstream therefrom. The interior rails are shown in FIG. 2A as terminating at the far side edge of the conveyor 74, while the outer rails are shown as continuing over the support surface 58 to guide the separated articles into the partially folded carton blanks. As best shown in FIG. 4, the guide rails 54 are upwardly spaced from the support surface 58, and the outer rails which extend over the support surface 58 may be separated to allow the lugs 70 to pass between them. Although now shown for the sake of clarity, it will be understood that the rail segments would be supported by suitable structure such as the support structure 56 at the left of FIG. 4.

Figure 5:
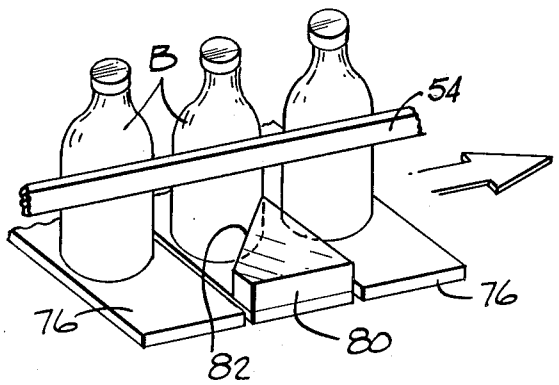
FIG. 5 is a partial pictorial view showing the article separating element in engagement with adjacent articles.

The pins or lugs 80 extend toward the infeed conveyor and away from the lugs 70 a relatively short distance, enough only to contact the articles B in the closest row of diagonally moving articles. The trailing surface of the lugs 80 include a sloped or tapered face 82. The lug 80 thus functions as a wedge to insert itself between adjacent articles B and, in cooperation with the diagonal sections of the side guides 54, separates a group of articles downstream of the lug 80 from articles upstream of the lug. This action is further illustrated in FIG. 5, wherein the lug 80 is shown engaging adjacent bottles in the process of wedging itself between them. It will be understood that the dimensions of the wedge-shaped lugs 80, the spacing between adjacent lugs 80 and the dimensions of the containers B are interrelated so that the heel of the tapered face 82 maintains the containers in position to allow the point on the following wedge to engage the containers at the proper location.

Figure 2B:
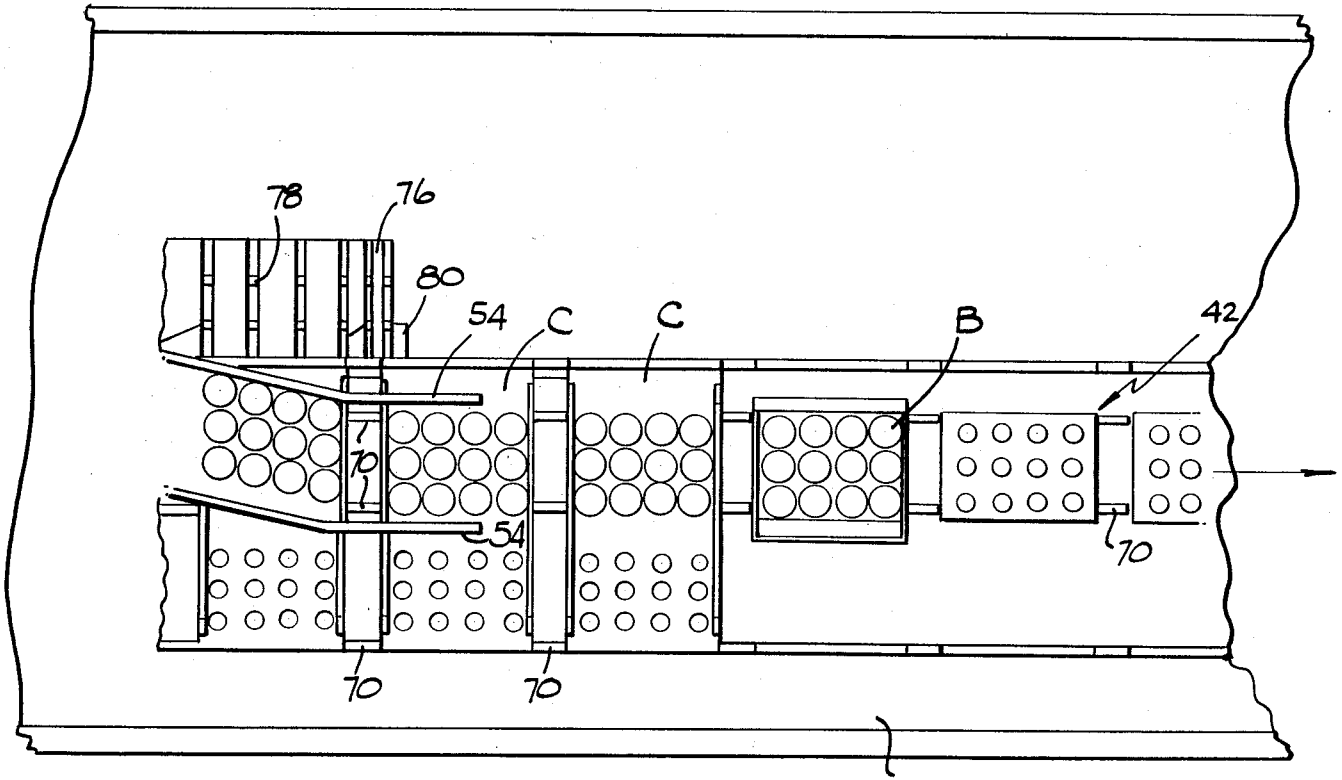
FIG. 2B is a plan view of the downstream portion of the packaging machine of FIG. 2A.

In operation, articles such as bottles are fed into the packaging machine on the infeed conveyor 46 and are directed by the guide rails onto the take-off conveyor 74. The speed of the take-off conveyor is slightly greater than the speed of the infeed conveyor so as not to have the line pressure of the incoming articles interfere with the separation of the articles into groups. As the wedge-shaped element 80 comes into contact with adjacent bottles, it moves between them and separates them. As the bottles in the first row engaged by the lug 80 are moved downstream and guided onto the support surface 58, the downstream movement of the lug brings it into contact with articles in the next row of articles, separating them in the same manner and moving the newly separated group of articles onto the support surface 58 so that they follow the separated group of articles from the first row. The same thing takes place with the articles in the third row. The group of articles from the third row is guided by the outer guide rail so that the three groups of separated articles are continued to be moved onto the support surface, as best illustrated at the far right of FIG. 2A, until they are guided into place as shown in FIG. 2B. Suitable folding equipment, not shown, then completes the folding steps depicted in FIGS. 1C and 1D, to form the finished loaded carton 42 at the downstream end of FIG. 2B.

Because the articles are positively moved by conveyor 74 during transfer from the infeed conveyor 46 to the carton blanks on the support surface 58 there is no need to damp the article feed pressure as there is when can feed pressure is relied on to push the cans over a stationary surface. By timing the rate of speed of the transfer conveyor 74 with the movement of the partially folded carton blanks, the transfer of the articles to the carton blanks is smooth and without interference, thereby reducing the possibility of the articles falling and creating a jam.

The small size of the wedge-shaped separator, particularly as to the distance it extends in from the edge of the transfer conveyor 74 toward the infeed conveyor, reduces the structural requirements for supporting the separator element 80 and minimizes the amount of space that must be allotted to the element and its support structure in order to accommodate the lower run of the conveyor 74. Further, the use of lugs to move the partially folded carton blanks instead of flight bars facilitates the changeover required in order to produce a different size carton. Thus to package articles in a carton of different width from the one being run it is merely necessary to change the location of the lugs in order to change the pocket size between lugs. To arrange the locations of the separator lugs 80 to correspond to the different pocket size is then a relatively simple matter due to their convenient size and the ability to remove and replace them simply and quickly.

It should be understood that the term "carton blank" when used herein is not intended to be limited to a flat carton blank as it exists prior to any initial or intermediate fabrication steps, but may instead refer to a carton blank which has been folded to the configuration of the partially folded blank shown in FIG. 1B or to an open-ended carton sleeve which has been opened to present the open end of the sleeve to the incoming articles to be packaged.

It should now be understood, after reading the foregoing description, that the invention is not necessarily limited to all the specific details described in connection with the preferred embodiment which do not affect the overall basic function and concept of the invention may be made by those skilled in the art without departing from the spirit and scope of the invention, as defined in the appended claims.

What is claimed is:

1. In a machine for packaging articles in a carton:

first conveyor means for moving a plurality of adjacent rows of articles in a downstream direction;

means laterally spaced from the first conveyor means for moving spaced carton blanks in said downstream direction;

second conveyor means between the first conveyor means and the carton blank moving means, the second conveyor means extending in said downstream direction;

a plurality of spaced parallel stationary guide rails mounted above the first and second conveyor means and extending diagonally from the first conveyor means, across the second conveyor means to the carton blank moving means, the second conveyor means moving the plurality of adjacent rows of articles and the guide rails guiding the moving adjacent rows of articles along a predetermined diagonal path of travel; and wedge means on the second conveyor means adjacent the carton blank moving means, the wedge means extending upwardly from the second conveyor means and laterally in a direction away from the carton blank moving means over a portion of the width of the second conveyor means, the wedge means being substantially aligned with the spaces between adjacent carton blanks and being positioned to contact and wedge apart adjacent articles in the nearest row of diagonally moving articles on the second conveyor means and to subsequently sequentially contact adjacent rows of diagonally moving rows of articles on the second conveyor means, the wedge means thereby separating the articles into groups of predetermined number, whereby groups of articles are moved onto the moving carton blanks.

2. A machine for packaging articles according to claim 1, wherein the means for moving carton blanks comprises means for pushing the carton blanks downstream, the pushing means being spaced from each other to form pockets therebetween, each pocket adapted to hold a carton blank having an open end facing the second conveyor means.

3. A machine for packaging articles according to claim 2, wherein the second conveyor means is moved downstream at the same speed as the carton blank moving means.

* * * * *